US005348346A

United States Patent [19]

Unger

[11] Patent Number: 5,348,346

[45] Date of Patent: Sep. 20, 1994

[54] SKI STICK

[75] Inventor: Michael Unger, Mäntyharju, Finland

[73] Assignee: Neste OY, Finland

[21] Appl. No.: 94,053

[22] PCT Filed: Dec. 18, 1992

[86] PCT No.: PCT/FI92/00347

§ 371 Date: Jul. 20, 1993

§ 102(e) Date: Jul. 20, 1993

[87] PCT Pub. No.: WO93/11839

PCT Pub. Date: Jun. 24, 1993

[30] Foreign Application Priority Data

Dec. 18, 1991 [FI] Finland ..... 915982

[51] Int. Cl.[5] ..... A63B 53/12

[52] U.S. Cl. ..... 280/819; 135/65; 428/36.1

[58] Field of Search ..... 280/819, 821, 824, 820; 428/36.1, 36.3, 36.4; 135/65

[56] References Cited

U.S. PATENT DOCUMENTS

| | | | |
|---|---|---|---|
| 3,972,529 | 8/1976 | McNeil | 280/814 |
| 4,301,201 | 11/1981 | Stout | 428/36 |
| 5,024,866 | 6/1991 | Goode | 428/36.4 |

FOREIGN PATENT DOCUMENTS

| | | |
|---|---|---|
| 1054643 | 5/1979 | Canada . |
| 432721 | 12/1990 | European Pat. Off. . |
| 1728575 | 2/1976 | Fed. Rep. of Germany . |
| 3017336 | 11/1981 | Fed. Rep. of Germany . |
| 55612 | 8/1976 | Finland . |
| 915981 | 12/1991 | Finland . |
| 410938 | 2/1976 | Sweden . |
| 508407 | 8/1968 | Switzerland . |

*Primary Examiner*—Richard M. Camby
*Attorney, Agent, or Firm*—Steinberg, Raskin & Davidson

[57] ABSTRACT

The invention relates to a ski stick, which comprises a hollow reinforced-plastic profile (10). In the inventive ski stick, a profile wall (11) contains at least one longitudinally extending reinforcement element (13), which is at least partially embedded in the manufacturing step of the profile (10) in the wall structure (11) as an integral part thereof. The reinforcement element (13) may extend along the entire length of the reinforced-plastic profile or partially along its length, and its cross-sectional form may be circular or longitudinal or angular, e.g. triangular.

19 Claims, 1 Drawing Sheet

SKI STICK

The invention relates to a ski stick, whose stem portion is formed of a hollow reinforced-plastic profile.

Ski sticks are known, in which the stem portion is formed of a hollow reinforced-plastic profile. Usually, the reinforced-plastic profile has a circular profile by cross-section, which may also taper towards the other end.

Ski-stick structures are also known, which have a longitudinal cross-sectional profile deviating from a circular form. Thus, e.g. in the DE patent publication 1728575 ski sticks have been described, which have different non-circular, e.g. elliptic cross-sections. A profile with an elliptic cross-section has a good stiffness on the plane of the longer diameter of the cross-section, but a poor stiffness on the plane of a shorter cross-sectional axis. It is also more difficult to mechanically manufacture profiles with an elliptic cross-section. Possibly for these reasons, ski sticks with an elliptic cross-section have not been seen on the market.

The present invention relates to a ski stick, which comprises a hollow reinforced-plastic profile, which is reinforced such that the profile has an excellent stiffness both in the direction of the cross-sectional longer axis and in the direction of the shorter axis, and which profile is extremely easy to manufacture mechanically into exact dimensions. Another certain inventive object is to achieve a ski stick, whose lightness, bending strength and durability clearly exceed the ski-stick solutions known.

Thus, the inventive ski stick having a hollow reinforced-plastic profile is characterized in that the profile wall includes at least one reinforcement element extending in the longitudinal direction, which is at least partially embedded in the manufacturing step of the reinforced-plastic profile in a wall structure as an integral part thereof.

Such a structure is previously unknown in ski sticks. It is on the other hand known in the manufacture of hollow profiles to support the profile with different reinforcement structures from the inside. E.g. in the DE patent publication 3017336, it is known to manufacture mast profiles of sailing boats, inside which are fixed rods formed by fibers extending in the longitudinal direction and having a high tensile strenth. However, the manufacture of the profiles described in the publication is very cumbersome, since the rods are fixed to the inner side of the profile by gluing between different extensions and grooves. By means of the method described, it may be possible to manufacture profiles having only a considerably large transverse surface, and the gluing is not necessarily succesful. An essential difference between the inventive profile and the mast profile described in the DE publication, if fairly different applications and dimensional differences are not taken into account, is the fact that the reinforcement element is fixed according to the DE publication to a completed profile afterwards (bu gluing), and it does not form an integral part of the wall structure of the profile, which integral part is fixed in position at the same time as the profile has been manufactured.

According to a certain preferred embodiment of the invention, the ski-stick profile is manufactured by means of a pultrusion process, wherein the profile is formed on top of said reinforcement element or elements. Such a pultrusion is e.g. a tape winding pultrusion method, in which on top of a central core to be used as an inner mold are placed reinforcement fibers wetted with a binder, around the central core covered with fibers is tightly wound a tape, the binder is hardened by means of heat or radiation, and finally, the central core and the tape are removed for obtaining a hollow tube profile having a generally smooth outer surface.

Said process may be applied to the manufacture of the inventive ski-stick profiles in a manner described in the Finnish patent application FI 915981 as being modified such that the inventive reinforcement profiles are caused to come into contact with the central core before embedding said fibers or such that a certain amount of fibers is first placed on the central core, the inventive reinforcement elements are then placed on the core, and reinforcement fibers wetted with the binder are then again added, whereby the reinforcement elements are in the final product completely located inside the wall of the rod profile.

The inventive ski stick may contain one or more reinforcement elements. Each reinforcement element may extend completely or partially along the entire stick length. Each reinforcement element is preferably placed and especially in the case that the cross-section of the stick profile is e.g. elliptic, on the plane of the longer cross-sectional axis. If there are two reinforcement elements, they are preferably placed on the end areas of the longer cross-sectional line of the stick profile, whereby a maximal stiffness is reached on this plane.

Although the inventive ski-stick profile is especially applicable to be used in sticks having an elliptic transverse surface, it is to be noted that the invention may be equally well be applied to such stick profiles, which have a circular cross-section. Such profiles may equally well be manufactured in the inventive manner on planes directed as desired.

In the inventive ski stick, the reinforcement element may be a hollow, tubular profile and also a closed profile. The reinforcement element is preferably made of the same material as the material of the profile of the stick portion itself, whereby, when forming the stick profile, the reinforcement element connects to the wall material of the stick as an integral part thereof, which cannot be removed from the wall. For this reason, its reinforcing effect is maximal. However, it is possible that the reinforcement element is made of some other material than the material of the stick profile without deviating from the scope of the invention.

Other materials to be considered are e.g. metals, such as aluminium and steel, as well as various thermoplastic and thermosetting polymers. For obtaining as light a structure as possible, the reinforcement elements are preferably formed of reinforced plastics.

The cross-sectional form of the inventive reinforcement element may be selected according to the desired reinforcing effect. Thus, the cross-sectional form be be longitudinal, circular or angular. A preferable form is generally a triangular cross-section. Such a profile has a very great torsion-resistant effect relative to the longitudinal and transverse direction of the cross-section.

As a material for the inventive profile may be used e.g. metals, thermosetting and thermoplastic resins or wood. Examples of suitable metals are aluminium, steel and light metal. Examples of thermoplastis resins include nylon, polyesters, phenol resins, epoxy resins, polycarbonates and polyolefines. The synthetic materials are most preferably reinforced with fibers, which may be selected from a group consistings of inorganic fibers, such as glass fibers, carbon fibers, boron fibers, ceramic fibers and metal fibers, and organic fibers, such as nylon, kevlar, polyester and polyolefine fibers.

The invention is next described with reference to the accompanying figures, wherein FIG. 1 shows as a cross-section the inventive ski stick provided with a reinforcement element;

Figure 1:
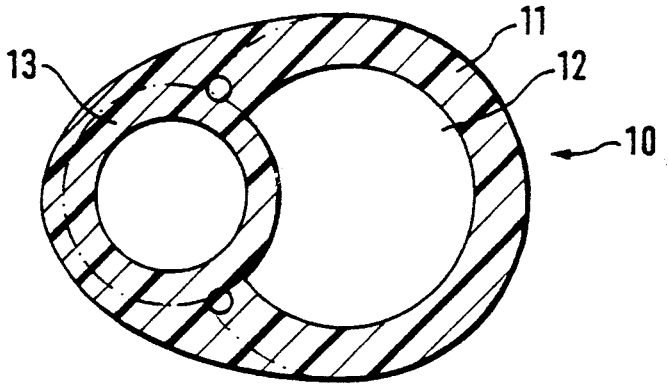
Figure 2:
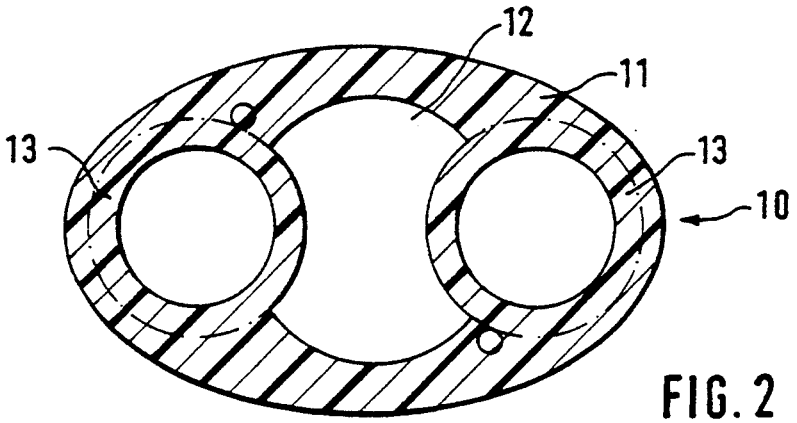
FIG. 2 shows as a cross-section the ski stick provided with two reinforcement elements.

FIG. 1 shows as cross-section a hollow ski stick 10, in which a wall 11 surrounds a hollow inner space 12. A hollow reinforcement element 13 having a circular cross-section is partially embedded in the wall 11.

FIG. 1 shows a corresponding ski stick, but in this case two hollow reinforcement elements 13 having a circular cross-sect/on are partially embedded in the wall 11.

Figure 3:
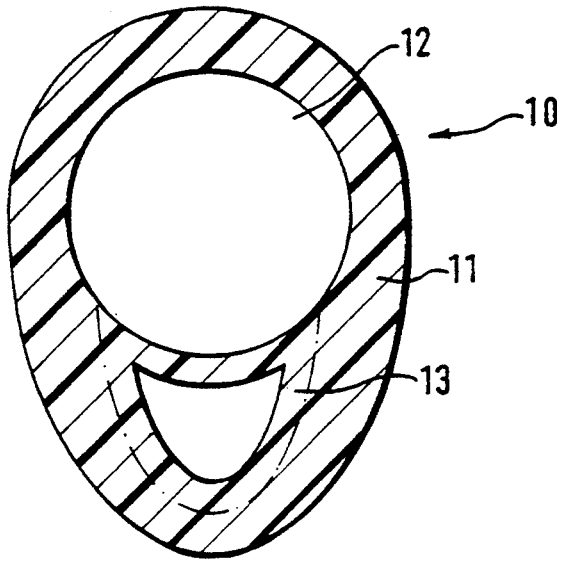
FIG. 3 shows as a cross-section the ski stick provided with a rectangular reinforcement element.

In the embodiment of FIG. 3, the cross-sectional form of the reinforcement element 13 is generally triangular, and in this case the reinforcement element is completely embedded inside the wall 11 such that only the side on the side of the inner space 12 of the reinforcement element 13 could be seen in the cross-section of the stick. However, the reinforcement element 13 could also be totally embedded inside the wall 11.

The cross-sectional form of the triangular reinforcement element 13 according to the figure is especially preferable, when improved stiffness properties are desirable also in the direction of the shorter cross-sectional axis of the stick.

I claim:

1. A ski stick comprising a hollow reinforced-plastic profile (10) having a profile wall (11) and at least one reinforcement element (13) extending in the longitudinal direction, said at least one reinforcement element (13) being at least partially embedded in the manufacturing step of the profile (10) in the profile wall (11) as an integral part thereof, said ski stick being manufactured by a pultrusion process in which the profile (10) is formed on top of said at least one reinforcement element (13).

2. A ski stick according to claim 1, comprising one reinforcement element (13) which extends partially or completely along the entire length of the stick (10).

3. A ski stick according to claim 1, comprising at least two reinforcement elements (13) which may each extend partially or completely along the entire length of the stick (10).

4. A ski stick according to claim 3, wherein the cross-section of the ski profile (10) is elliptic and said reinforcement elements (13) are placed on a longer axis line of the elliptical cross-section.

5. A ski stick according to claim 1, wherein said at least one reinforcement element (13) is hollow.

6. A ski stick according to claim 1, wherein said at least one reinforcement element (13) has a closed profile.

7. A ski stick according to claim 1, wherein said at least one reinforcement element (13) comprises a reinforced-plastic profile having a plastic portion and reinforcement fibers arranged therein.

8. A ski stick according to claim 1, wherein said at least one reinforcement element (13) comprises a material selected from the group consisting of metals, thermosetting and thermoplastic resins and wood.

9. A ski stick according to claim 7, wherein the plastic portion of the reinforced plastic comprises a material selected from the group consisting of nylon, polyesters, phenol resins, epoxy resins, vinyl ester resins, polycarbonates and polyolefines.

10. A ski stick according to claim 9, wherein the reinforcing fibers are selected from the group consisting of inorganic fibers, glass fibers, carbon fibers, boron fibers, ceramic fibers and metal fibers, and organic fibers, nylon, kevlar, polyester and polyolefine fibers.

11. A ski stick comprising a hollow reinforced-plastic profile (10) having a profile wall (11) and at least one reinforcement element (13) extending in the longitudinal direction, said at least one reinforcement element (13) being at least partially embedded in the manufacturing step of the profile (10) in the profile wall (11) as an integral part thereof, said profile having an elliptic cross-section, said at least one reinforcement element being arranged on a longer axis line of the elliptical cross-section.

12. A ski stick according to claim 11, comprising one reinforcement element (13) which extends partially or completely along the entire length of the stick (10).

13. A ski stick according to claim 11, comprising at least two reinforcement elements (13) which extends partially or completely along the entire length of the stick (10).

14. A ski stick according to claim 11, wherein said at least one reinforcement element (13) is hollow.

15. A ski stick according to claim 11, wherein said at least one reinforcement element (13) has a closed profile.

16. A ski stick according to claim 11, wherein said reinforcement element (13) comprises a reinforced plastic profile having a plastic portion and reinforcement fibers.

17. A ski stick according to claim 11, wherein said reinforcement element (13) comprises a material selected from the group consisting of metals, thermosetting resins, thermoplastic resins and wood.

18. A ski stick according to claim 16, wherein the plastic portion comprises a material selected from the group consisting of nylon, polyesters, phenol resins, epoxy resins, vinyl ester resins, polycarbonates and polyolefines.

19. A ski stick according to claim 18, wherein the reinforcing fibers are selected from the group consisting of inorganic fibers, glass fibers, carbon fibers, boron fibers, ceramic fibers, metal fibers, organic fibers, as nylon, kevlar, polyester and polyolefine fibers.

* * * * *